US007588719B2

(12) United States Patent
Becker et al.

(10) Patent No.: US 7,588,719 B2
(45) Date of Patent: Sep. 15, 2009

(54) INSTALLATION FOR THE HEAT-TREATMENT OF PARTS

(75) Inventors: Horst Becker, Muelheim (DE); Friedhelm Kühn, Muelheim (DE)

(73) Assignee: LOI Thermprocess GmbH, Essen (DE)

( * ) Notice: Subject to any disclaimer, the term of this patent is extended or adjusted under 35 U.S.C. 154(b) by 522 days.

(21) Appl. No.: 10/508,735

(22) PCT Filed: Mar. 11, 2003

(86) PCT No.: PCT/EP03/02461

§ 371 (c)(1),
(2), (4) Date: Mar. 8, 2005

(87) PCT Pub. No.: WO03/081156

PCT Pub. Date: Oct. 2, 2003

(65) Prior Publication Data

US 2005/0161869 A1 Jul. 28, 2005

(30) Foreign Application Priority Data

Mar. 27, 2002 (DE) ..... 102 13 991
Dec. 17, 2002 (DE) ..... 102 59 247

(51) Int. Cl.
*C21D 1/74* (2006.01)

(52) U.S. Cl. ..... 266/259; 266/252

(58) Field of Classification Search ..... 266/259, 266/249–252; 432/11, 18, 128, 138, 137, 432/153, 195
See application file for complete search history.

(56) References Cited

U.S. PATENT DOCUMENTS 1,362,296 A * 12/1920 Hagan et al. ..... 432/34
2,892,744 A * 6/1959 Myers ..... 148/631
3,693,812 A * 9/1972 Mahr et al. ..... 414/148
4,496,312 A * 1/1985 Yamada et al. ..... 432/11
4,622,006 A * 11/1986 Hohne ..... 432/11
5,035,405 A * 7/1991 Reuter ..... 266/250
5,722,825 A * 3/1998 Edenhofer ..... 432/138

FOREIGN PATENT DOCUMENTS

GB 2162294 * 1/1986
GB 2162294 A * 1/1986
WO WO 86/02103 * 10/1986

OTHER PUBLICATIONS

Kuehn et al, DE 19919738 Machine Translation, Aug. 3, 2000.*
Osamu, JP 05-239558 Machine Translation and English abstract, Sep. 17, 1993.*

* cited by examiner

*Primary Examiner*—Scott Kastler
(74) *Attorney, Agent, or Firm*—Fay Sharpe LLP

(57) ABSTRACT

An installation for the heat-treatment of parts includes a rotary hearth that can be rotated in a timed manner and which has an outer and an inner wall limiting a furnace chamber that is divided up into a heating zone and at least one treatment zone by vertically movable doors. The outer wall in the heating zone is provided with a closable opening for charging or discharging the furnace. The installation further comprises a transport device for transporting the parts into or out of the rotary hearth furnace and a quenching device. In addition, a second closable opening is disposed in the outer wall of the rotary hearth furnace in the last treatment zone. A sluice is disposed adjacent to the second closable opening and a quenching device is designed as a quenching bath and connected to the rotary hearth furnace via the sluice.

13 Claims, 2 Drawing Sheets

INSTALLATION FOR THE HEAT-TREATMENT OF PARTS

FIELD OF THE INVENTION

The present invention relates to an installation for the heat-treatment of parts, which comprises a rotary hearth furnace that can be rotated in a timed manner which has an outer and an inner wall limiting a furnace chamber which is divided up into a heating zone and at least one treatment zone by means of vertically movable doors, the outer wall in the heating zone being provided with a closable opening for charging and discharging the furnace. The installation further comprises a transport device for transporting the parts into or out of the rotary hearth furnace and a quenching device.

BACKGROUND OF THE INVENTION

Such an installation is known from the DE C1 34 27 716. It concerns an installation for hardening individual parts comprising a rotary hearth furnace and a hardening press. The rotary hearth furnace has a sluice-like charging or discharging zone which is formed by means of vertically movable doors arranged on either side of the charging and discharging opening. Once the furnace door has been opened, the parts can be removed individually from this charging or discharging zone by means of a charging and discharging robot and conveyed into the hardening press.

There is need for the installation is to be used more universally, i.e. to permit not only the heat-treating of individual parts but also the heat-treating of entire charges located on charge carriers, e.g. grates. Whole charges of parts are generally quenched in a quenching bath.

The cycle time, i.e. the time between placing a part in the rotary hearth furnace and removing it from the rotary hearth furnace is relatively long with the known installation as only one opening is used for both charging and discharging. Therefore, it is also necessary to minimise the cycle time.

Therefore, the object of the present invention was to create an installation of the type described above which is universal and which has a short cycle time.

SUMMARY OF THE INVENTION

This object is achieved in the installation described above by the characterising features of claim 1.

The rotary hearth furnace has two closable openings which are either both used for charging and discharging or one is used solely for charging and the other solely for discharging. A sluice is disposed upstream of the second opening. A quenching bath is connected directly to rotary hearth furnace by means of this sluice. The inventive installation can be used universally. Furthermore, the cycle time can be minimised and thus the hourly throughput of parts increased.

The two openings are disposed next to each other at a small circumferential distance, the circumferential distance between the first and the second opening being preferably substantially 45°. Depending on the space available, the circumferential distance can also be up to 90° in individual cases.

In a preferred embodiment a sluice for charging the furnace is disposed upstream of the first opening so that the first opening is used solely for charging. Consequently, the second opening is used solely for discharging the furnace.

In one advantageous embodiment, the first opening is disposed vertically above the furnace chamber. A charging sluice is disposed upstream of the first opening in the vertical direction, said charging sluice being designed as a known elevator sluice, with a transport device for the horizontal transport of the parts. Thus the opening for charging can be disposed relatively close or immediately adjacent to the discharging opening. The advantage of this design is that the furnace chamber available for heat treatment can be used optimally.

As heat treatment generally takes place in a controlled atmosphere or in a treatment atmosphere, both the sluice and, if provided, the charging sluice are of gas-tight design.

The sluices have at least one sluice door which is located substantially at right angles to the opening in the outer wall. The sluice door is therefore located in a side wall of the sluice. The quenching bath, which is connected to the rotary hearth furnace by means of the sluice, is thus disposed on the side wall of the sluice.

A second quenching device is preferably connected to the rotary hearth furnace by means of the sluice. This can be a gas quenching chamber or another quenching bath. This considerably increases the flexibility of the installation as the parts can optionally be quenched at different temperatures. The two quenching devices are disposed on the opposing side walls of the sluice.

A transport device in the form of a pusher device is preferably assigned to at least one opening. The charge is transported into the discharging sluice in a simple manner by means of the pusher device and passed from there into the quenching bath which adjoins the discharging sluice. If the first opening is also provided with a charging sluice, a pusher device can also be used here. The parts, which are packed in baskets or similar containers, are transported into the sluice by means of the pusher device and from there passed into the rotary hearth furnace.

One of the vertically movable doors is located between the first opening and the second opening so that a zone separation takes place between charging and discharging.

At least one additional vertically movable door to change the length of the heating zone and/or treatment zone is preferably provided. If required, the additional door can be used for zone separation. All doors can be controlled and therefore moved individually.

In the phases in which the hearth of the rotary hearth furnace rotates, all doors are normally open, i.e. all doors are simultaneously raised. In the phase in which the hearth does not rotate, all doors which are used for zone separation are closed. If there is no need for zone separation using the additional door, this door is also open during the phases in which the hearth is not moving. If the additional door is needed for zone separation and thus for changing the length of the heating and/or treatment zone, at least one of the doors which was previously used for zone separation is kept constantly open during the phase in which the hearth is not moving. Thus the length of the heating zone and/or treatment zone can be optimised as required for different heat-treatment processes.

The invention further provides a rotary hearth furnace for the heat-treatment of parts which comprises a rotary hearth which can be rotated in timed manner, an outer and an inner wall limiting a furnace chamber which is divided up into a heating zone and at least one treatment zone by means of vertically movable doors, and a closable charging and discharging opening which is disposed in the outer wall adjacent to the heating zone. The rotary hearth furnace is characterised in that a second closable charging and discharging opening is disposed in the outer wall adjacent to the heating zone and at a distance to the first charging and discharging opening and that the rotary hearth can be rotated in both directions.

The invented rotary hearth furnace makes it possible to choose between two charging and discharging options. Both charging and discharging openings can be used both for charging and discharging. Both charging and discharging openings are located adjacent to the heating zone so that, regardless of which opening is charged, it is ensured that the parts enter the heating zone directly after they have been placed in the furnace. It is only necessary to change the direction of rotation of the rotary hearth accordingly. This considerably improves the functionality of the rotary hearth furnace.

The heating zone preferably extends over an area of substantially 90° between the first and the second charging and discharging opening.

It is advantageous if at least two treatment zones are provided which each adjoin the heating zone and for each of which a different treatment temperature and a different treatment atmosphere can be set.

As heat treatment generally takes place in a controlled atmosphere, the sluice is preferably of gas-tight design.

In one preferred embodiment, doors are provided on both sides immediately next to the first charging and discharging opening so that a charging and discharging zone is formed which can be heated.

Furthermore, the invention provides an installation which comprises a rotary hearth furnace according to the invention, a transport device for transporting the parts into or out of the rotary hearth furnace and a quenching device, characterised in that a sluice is disposed adjacent to the second charging and discharging opening, that a second quenching device is provided which is designed as a quenching bath and which is connected to the second opening of the rotary hearth furnace by means of the sluice.

This installation is particularly universal as a quenching device is provided at every opening. Every opening is used both for charging and discharging. The direction of rotation of the rotary hearth furnace is changed depending on through which of the two openings the parts enter the furnace so that the parts always enter the heating zone first.

BRIEF DESCRIPTION OF THE DRAWINGS

The invention will now be described in the following by means of a preferred embodiment and the attached drawing.

The drawing shows in

DETAILED DESCRIPTION OF THE PREFERRED EMBODIMENTS

Figure 1:
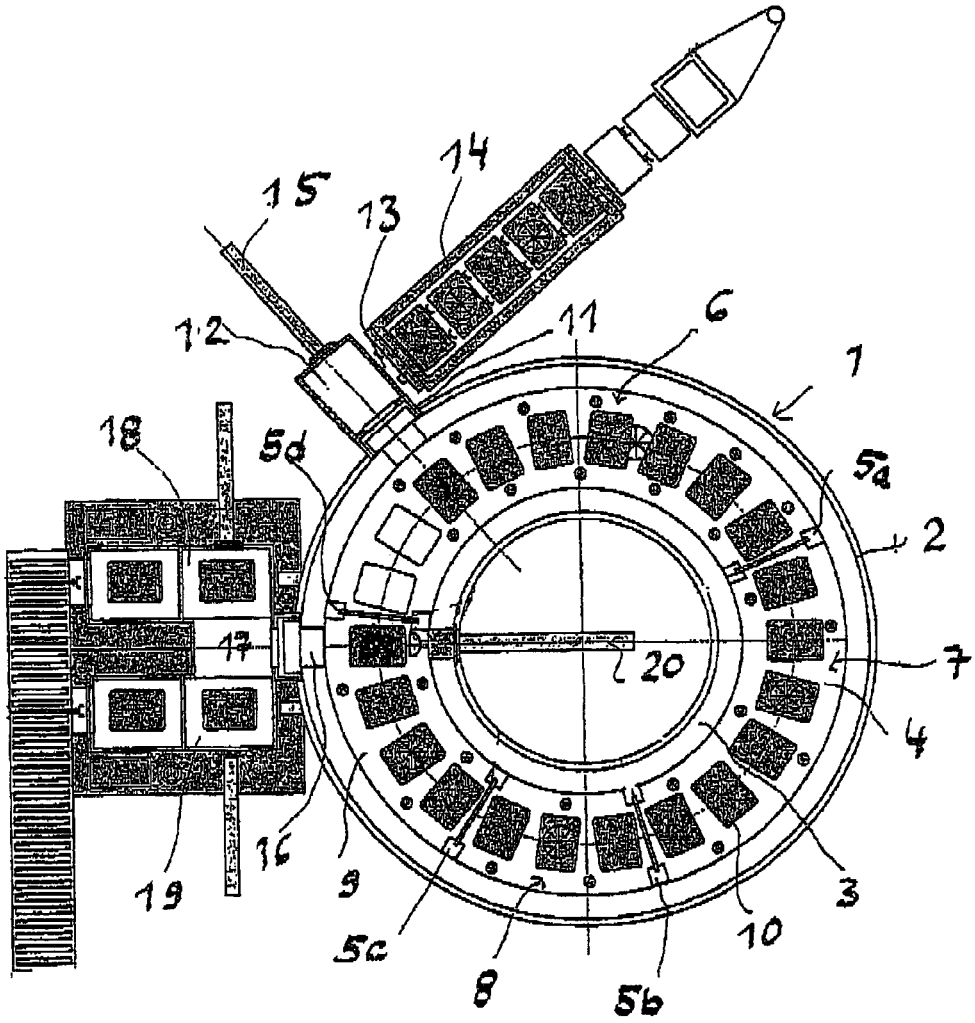
FIG. 1 a schematic top view of a first embodiment of a heat-treatment installation; and, in FIG. 2, a schematic top view of a second embodiment of a heat-treatment installation.

The installation for hardening parts according to FIG. 1 has a rotary hearth furnace 1 which can be rotated in a timed manner solely in one direction, i.e. clockwise. A stationary brick outer wall 2 and an inner wall 3 made of refractory bricks form, together with the rotary hearth and a ceiling not shown, a ring-shaped furnace chamber not shown in the top view. The furnace chamber is divided by means of doors 5*a*-5*d* into a heating zone 6 and three treatment zones 7, 8, 9, i.e. a first and a second diffusion/carburising zone 7, 9, and carburising zone 8. The doors 5*a*-5*d* can be raised vertically in a manner not shown. The parts are located on charge carriers 10 in the form of grates.

The outer wall is provided, at the beginning of the heating zone 6, with a first closable opening 11 which is disposed downstream of a gas-tight sluice 12 for charging the furnace. The opening 10 between the furnace chamber and the sluice 12 can be opened or closed in the known manner by means of a furnace door. The sluice 12 has a sluice door 13 which is located substantially at right angles to the opening 10 and which is alternately opened or closed for charging. Before the furnace is charged, the charge carriers 10 with the parts are located in a pre-oxidation furnace 14. The charge carriers 10 are pushed out of the sluice 12 into the furnace chamber by means of a first pusher device 15. As the rotary hearth rotates clockwise, the charge carriers 10 enter the heating zone 6 first and from the heating zone 6 the treatment zones 7, 8 and 9. The treatment zones are diffusion/carburising zones in which different treatment temperatures and a different treatment atmosphere can be set. The treatment atmosphere or a neutral gas, for example nitrogen, can be present in the sluice 12 and the charging sluice.

The outer wall 2 is provided with a second closable opening 16 which is disposed downstream of a gas-tight sluice 17 for discharging. The circumferential distance between the two openings 11 and 16 is approx. 45°. A first quenching bath 18 and a second quenching bath 19, each of which has a different temperature, are connected to the sluice 17, one on each side thereof, by means of sluice doors which are not shown in more detail and which are located substantially at right angles to the opening 16.

The different charge carriers 10 with the parts are discharged at the end of the last treatment zone by means of a second pusher device 20. Just like charging, discharging is performed in a timed manner. When a charge carrier 10 has arrived at the end of the last treatment zone, the second opening 16 opens and the charge carrier 10 is transported by means of the pusher device 20 into the sluice 17 and from there optionally into one of the two quenching baths 18, 19. Naturally the second opening 16 is closed again after each discharge.

A vertically movable door 5*d* is located between the first opening 11 and the second opening 16 so that charging and discharging take place in different zones, i.e. the heating zone 7 and the last treatment zone 9.

Modifications are perfectly possible within the scope of the present invention. For example, the circumferential distance between the two openings can be more or less than 45°. The circumferential distance should be as small as possible but for space reasons it can be up to 90°. The second quenching device can be designed as a gas quenching chamber. Additional doors can be used to change the length of the heating zone and/or the treatment zone.

Figure 2:
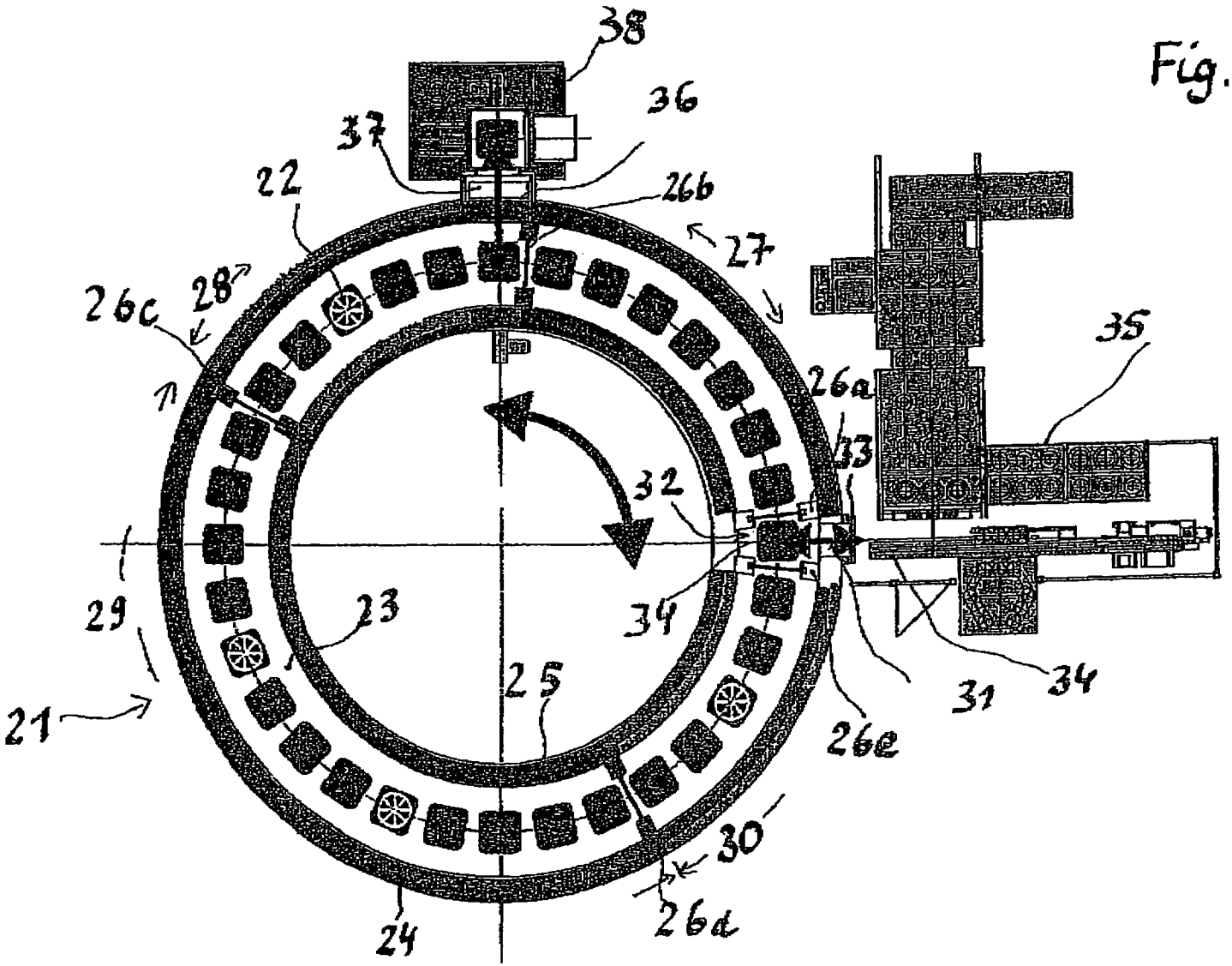

FIG. 2 shows a rotary hearth furnace 21 which is used for heat-treating as part of a process for hardening parts 22 and which has a rotary hearth 23 that can be rotated in a timed manner in both directions. A stationary brick outer wall 24 and an inner wall 25 made of refractory bricks form, together with the rotary hearth 23 and a ceiling not shown, a ring-shaped furnace chamber not shown in the top view. The furnace chamber is divided into a heating zone 27 and three treatment zones 28 to 30, i.e. a first and a second diffusion/carburising zone 28, 30, and carburising zone 29 by means of doors 26*a*-26*d*. The doors 26*a*-26*d* can be raised vertically in a manner not shown.

The outer wall is provided with a first opening 31 for charging and discharging which is adjoined on both sides by doors 26*a*-26*e* so that a charging and discharging zone is 32 is formed. A furnace door 33 closes the first opening 31.

Charging and discharging of the individual parts is performed by a charging and discharging robot 34. Charging is performed in a timed manner. After the door 26*a* has opened, the parts 22 which have been placed in the furnace chamber enter the heating zone 27 as the rotary hearth rotates counter-clockwise. The parts 22 on the rotary hearth 23 are passed through the treatment zones 28, 29 and 30. Different treatment temperatures and different treatment atmospheres can be set in the diffusions/carburising zones 28, 30. In this charging example, the first diffusion/carburising zone 28 is set so that the zone acts as a carburising zone. The second diffusions/carburising zone 30, i.e. the last treatment zone before discharging, acts as a diffusion zone, i.e. is set so that the C potential in the treatment atmosphere is reduced. The parts which arrive in the charging and discharging zone 32 are removed individually after the furnace door 33 has opened and quenched in a hardening device 35. Naturally, the furnace door 33 is closed again after every discharge.

The outer wall 24 is provided with a second closable opening 36 for charging or discharging which is disposed at a distance to the first opening 31 for charging or discharging. The heating zone 27 extends over an area of approx. 90° between the two charging and discharging openings 31, 36. The heating zone 27 can be closed immediately after the second charging and discharging opening 36 by means of a door 26*b*. The two openings 31, 36 are therefore each located adjacent to the heating zone 27. The direction of rotation of the rotary hearth selected depends on which of the two charging and discharging openings 31, 36 is charged. In any case the parts enter the heating zone after charging.

The second charging and discharging opening 36 is followed by a sluice 37 with a cooling bath 38 in the form of an oil bath. In the second charging and discharging opening 36, the parts 22, which are located in the known manner on charge carriers, are put into the furnace chamber and transported clockwise on the rotary hearth 23 through the furnace chamber. In this charging example, the second diffusion/carburising zone 30 is set as a carburising zone and the first diffusion/carburising zone 28 as a diffusion zone.

Modifications are perfectly possible within the scope of the present invention. For example, the heating zone 27 may extend over a larger area of the furnace chamber.

The invention claimed is:

1. An installation for the heat-treatment of parts comprising:

a rotary hearth furnace adapted to be rotated in a timed manner and comprising outer and inner walls for limiting a furnace chamber, said furnace chamber having vertically movable doors adapted to divide up said furnace chamber into a heating zone and at least one treatment zone;

a first opening provided in said outer wall for charging said heating zone, first means for closing said first opening, a charging sluice disposed exterior to said furnace chamber and located adjacent said first opening;

a second opening provided in said outer wall for discharging from a downstream treatment zone, second means for closing said second opening, said installation further comprising:

transport means for transporting said parts into and out of the hearth furnace, quenching bath means for quenching said parts after treatment in said rotary hearth furnace; and, sluice means arranged to connect said second opening and said quenching bath means, wherein said sluice means and said charging sluice have at least one sluice door, each sluice door being disposed at about a right angle to the associated opening in said outer wall.

2. The installation of claim 1 wherein the first and second openings for charging and discharging are disposed at a circumferential distance of about 45° from each other.

3. The installation as claimed in claim 1, wherein the first opening for charging is disposed vertically above the furnace chamber and is coupled to a charging sluice disposed vertically above the furnace chamber and designed as an elevator sluice.

4. The installation as claimed in claim 1, wherein a second quenching means is connected to the rotary hearth furnace by means of said sluice means.

5. The installation as claimed in claim 4, wherein the second quenching means is selected from the group consisting of a quenching bath and a gas quenching chamber.

6. The installation as claimed in claim 1, wherein all doors are individually controllable.

7. An installation for the heat-treatment of parts, comprising:

a rotary hearth furnace including a rotary hearth which can be rotated in a timed manner in one of a clockwise and a counter-clockwise direction, the furnace including an outer wall and an inner wall defining a furnace chamber;

a plurality of vertically movable doors dividing up the furnace chamber into a heating zone and at least one treatment zone;

a first closable opening for charging and discharging the furnace, the first closable opening disposed in the outer wall of the furnace chamber;

a second closable opening for charging and discharging the furnace, the second closable opening disposed in the outer wall of the furnace chamber, wherein each of the first and the second closable openings are located adjacent to the vertically movable doors defining the heating zone;

a first quenching device in selective communication with the first closable opening;

a second quenching device in selective communication with the second closable opening;

a sluice arranged to connect the second closable opening and the second quenching device; and a plurality of transport devices for transporting the parts into or out of the rotary hearth furnace.

8. The installation of claim 7, wherein the first closable opening is adjoined on both sides by the vertically movable doors so that a charging and discharging zone is formed.

9. The installation of claim 7, wherein the vertically movable doors divide the furnace chamber into three treatment zone, including a carburizing zone and two diffusion/carburizing zones which adjoin the carburizing zone and the heating zone.

10. The installation of claim 9, wherein different treatment temperatures and different atmospheres can be set in the two diffusion/carburizing zones.

11. The installation of claim 7, wherein the heating zone extends over a circumferential distance of about 90° between the first and second closable openings.

12. The installation of claim 7, wherein the second quenching device is a cooling bath.

13. The installation of claim 12, wherein the cooling bath is an oil bath.

* * * * *